US010090590B2

(12) United States Patent
Koskiniemi et al.

(10) Patent No.: US 10,090,590 B2
(45) Date of Patent: Oct. 2, 2018

(54) APPARATUS AND METHODS FOR ANTENNA PORT ISOLATION

(71) Applicant: Pulse Finland OY, Kempele (FI)

(72) Inventors: Kimmo Koskiniemi, Oulu (FI); Kimmo Honkanen, Oulu (FI); Jouni Liflander, Oulu (FI)

(73) Assignee: Pulse Finland Oy, Oulu (FI)

( * ) Notice: Subject to any disclaimer, the term of this patent is extended or adjusted under 35 U.S.C. 154(b) by 431 days.

(21) Appl. No.: 14/496,931

(22) Filed: Sep. 25, 2014

(65) Prior Publication Data

US 2015/0130667 A1 May 14, 2015

Related U.S. Application Data

(60) Provisional application No. 61/883,085, filed on Sep. 26, 2013.

(51) Int. Cl.
*H01Q 1/52* (2006.01)
*H01Q 9/04* (2006.01)

(52) U.S. Cl.
CPC ..... *H01Q 1/526* (2013.01); *H01Q 9/045* (2013.01); *Y10T 29/49016* (2015.01)

(58) Field of Classification Search
CPC ..... H01Q 1/526; H01Q 9/045
See application file for complete search history.

(56) References Cited

U.S. PATENT DOCUMENTS

| | | | | |
|---|---|---|---|---|
| 9,065,163 | B1 * | 6/2015 | Wu | H01P 3/12 |
| 2013/0229314 | A1 | 9/2013 | Kuehler et al. | |
| 2014/0266934 | A1 * | 9/2014 | Cook | H01Q 1/44 343/720 |
| 2014/0334768 | A1 * | 11/2014 | Chang | G02B 6/12 385/14 |

* cited by examiner

*Primary Examiner* — Hoang Nguyen
*Assistant Examiner* — Jae Kim
(74) *Attorney, Agent, or Firm* — Gazdzinski & Associates, PC

(57) ABSTRACT

Apparatus and methods for enhanced antenna port isolation are disclosed. In one embodiment, a spatially compact patch antenna apparatus is disclosed. A plurality of walls are incorporated into the antenna assembly's bottom cover. The walls are located under the radiating element located on a top cover of the antenna assembly. The walls are in one implementation oriented orthogonally with respect to one another, and are placed adjacent to respective antenna feeds. The walls are then at least partly metallized using, for example, a laser direct structuring (LDS) process, and are further connected to a ground plane of an external substrate. By incorporating the metallized wall structures on the existing plastic structure of the bottom cover, isolation between the antenna ports is improved without requiring installation of additional components, use of slots in the ground plane, or increased physical separation (i.e., distance). Manufacturing cost and consistency are also advantageously improved.

20 Claims, 3 Drawing Sheets

APPARATUS AND METHODS FOR ANTENNA PORT ISOLATION

PRIORITY

This application claims priority to co-owned U.S. Provisional Patent Application Ser. No. 61/883,085 filed Sep. 26, 2013 of the same title, which is incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

1. TECHNOLOGICAL FIELD

The present disclosure relates generally to antenna apparatus for use in electronic devices such as wireless radio devices, and more particularly in one exemplary aspect to an antenna apparatus, and methods of, inter alia, improving isolation between antenna ports.

2. DESCRIPTION OF RELATED TECHNOLOGY

In antennas with multiple fixed feed points, port isolation between the fixed feed points should be made as high as possible in order to reduce interference between one another. Improvement of antenna feed port isolation between multiple feed ports is possible by increasing the physical (i.e., distance) and electrical separation between the antenna feed ports. However, such physical separation may not be possible in designs with size constraints. Moreover, even where possible, such separation may have adverse effects on the operation of the antenna, such as by causing for example the antenna impedance matching to suffer, thereby reducing the underlying antenna electrical performance.

Another known solution for isolation improvement in similar patch antennas with several feed points is to use metal wants) or fixed shaped slot(s) on the antenna ground plane in between the antenna feed points, so as to alter the surface currents of the antenna ground plane and thus increase the isolation.

The metal wall(s) may also be located outside of the perimeter of the actual antenna to act as reflectors of sorts.

However, the foregoing techniques also suffer significant drawbacks. Specifically, slots disposed on the antenna ground plane can adversely affect the antenna impedance matching, as the antenna "sees" the ground plane shape or size differently with the slot(s) as opposed to without. This can significantly degrade the antenna's radiation characteristics.

Moreover, use of metal walls complicates the antenna structures and assemblies, and typically require separate components and labor to manufacture. Such separate components on the antenna assembly also may cause possible mechanical uncertainties such as possibly weakening the antenna assembly or alignment or location errors in the assembly, which can in turn ultimately affect electrical performance.

Accordingly, there is a salient need for, inter alia, an improved antenna solution that can enhance isolation between antenna ports without increasing the complexity or size design of the antenna, or introduce mechanical/electrical uncertainties or artifacts.

SUMMARY

The present disclosure satisfies the foregoing needs by providing, inter alia, improved antenna port isolation apparatus and methods useful for, e.g., mobile wireless devices. In a first aspect, antenna apparatus are disclosed. In one embodiment, the antenna apparatus includes a first cover element including at least one antenna radiating element; and a second cover element. In one variant, the second cover element includes at least: at least two feed ports, where said at least two feed ports are electrically coupled to said at least one antenna radiating element; and at least one shield element, at least a portion of said at least one shield wall element positioned between said first and second cover elements.

In one variant, the antenna apparatus is highly simplified in construction (e.g., relative to prior art discrete component approaches), and the at least one shield element is formed directly on a structure or portion of said second cover element (such as via an LDS, deposition, or other process), and is configured to increase an antenna isolation between said at least two feed ports.

In another variant, the antenna apparatus comprises a highly compact form factor, with the at least two ports in close proximity to one another, yet with a sufficient degree of electrical isolation between them so as to optimize operation of the antenna.

In another variant, the antenna functions as a patch antenna, and includes two feed ports configured to excite the patch antenna radiating element in two different operating modes.

In a second aspect, methods of improving isolation between ports in the aforementioned antenna apparatus are disclosed.

In a third aspect, methods of manufacturing the aforementioned antenna apparatus are disclosed.

In a fourth aspect, a method of adapting an existing multi-port antenna design so as to enhance feed port isolation is disclosed.

In a fifth aspect, a reduced-complexity patch antenna assembly with high manufacturing consistency is disclosed.

Further features of the present disclosure, its nature and various advantages will be more apparent from the accompanying drawings and the following detailed description.

BRIEF DESCRIPTION OF THE DRAWINGS

The features, objectives, and advantages of the disclosure will become more apparent from the detailed description set forth below when taken in conjunction with the drawings, wherein.

Figure 1:
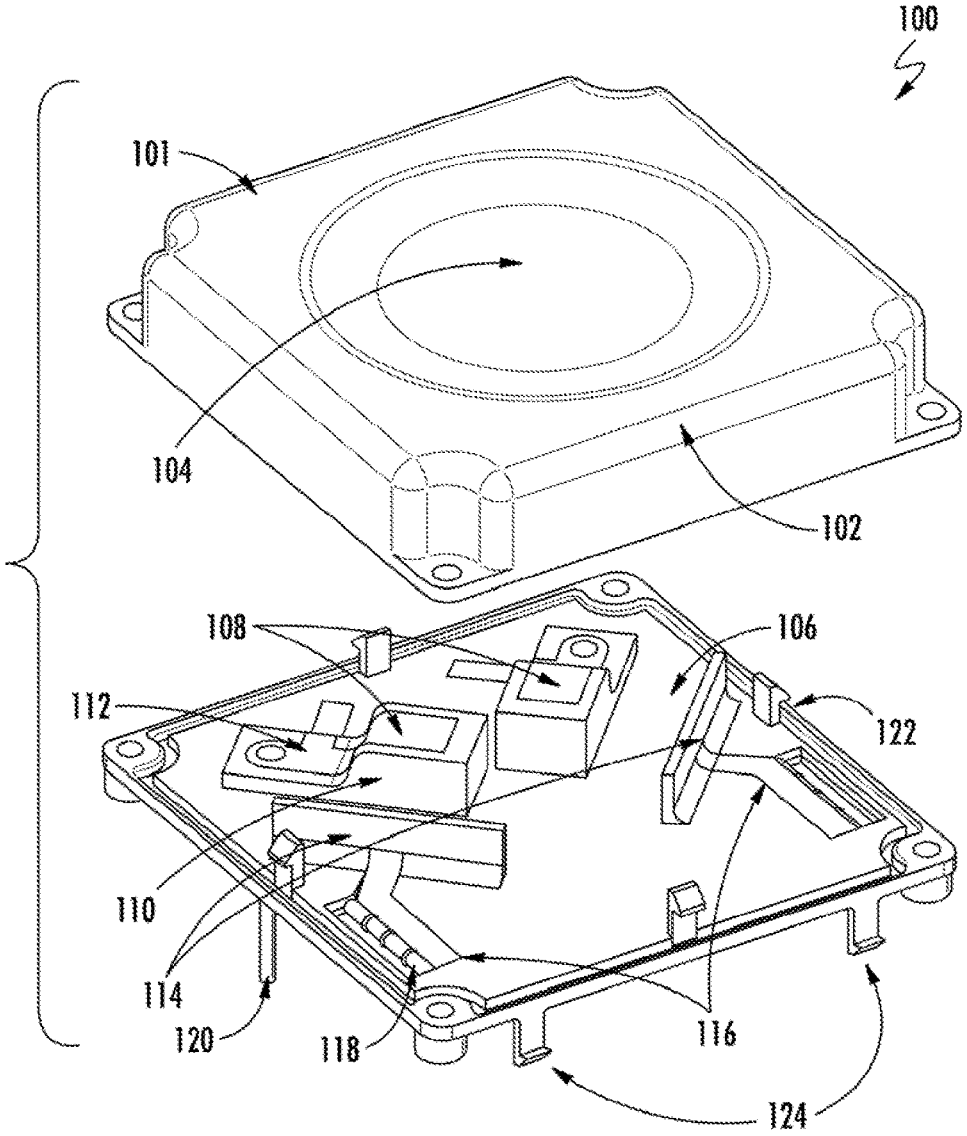
FIG. 1 is a perspective exploded view of one embodiment of an antenna apparatus, in accordance with the principles of the present disclosure.

All Figures disclosed herein are © Copyright 2013 Pulse Finland Oy. All rights reserved.

DETAILED DESCRIPTION

Reference is now made to the drawings wherein like numerals refer to like parts throughout.

As used herein, the terms "antenna," and "antenna system," refer without limitation to any system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like. The energy may be transmitted from location to another location, using, one or more repeater links, and one or more locations may be mobile, stationary, or fixed to a location on earth such as a base station.

As used herein, the terms "board" and "substrate" refer generally and without limitation to any substantially planar or curved surface or component upon which other material and/or components can be disposed. For example, a substrate may comprise a single or multi-layered printed circuit board (e.g., FR4), a semi-conductive die or wafer, or even a surface of a housing or other device component, and may be substantially rigid or alternatively at least somewhat flexible.

As used herein, the terms "frequency range", "frequency band", and "frequency domain" refer without limitation to any frequency range for communicating signals. Such signals may be communicated pursuant to one or more standards or wireless air interfaces.

As used herein, the terms "portable device", "mobile device", "client device", "portable wireless device", and "host device" include, but are not limited to, personal computers (PCs) and minicomputers, whether desktop, laptop, or otherwise, set-top boxes, personal digital assistants (PDAs), handheld computers, personal communicators, tablet computers, portable navigation aids, J2ME equipped devices, cellular telephones, smartphones, personal integrated communication or entertainment devices, or literally any other device capable of interchanging data with a network or another device.

As used herein, the terms "radiator," and "radiating element" refer without limitation to an element that can function as part of a system that receives and/or transmits radio-frequency electromagnetic radiation; e.g., an antenna.

As used herein, the teems "RF feed", "feed" and "feed conductor" refer without limitation to any energy conductor and coupling element(s) that can transfer energy, transform impedance, enhance performance characteristics, and conform impedance properties between incoming/outgoing RF energy signals to that of one or more connective elements, such as for example a radiator.

As used herein, the terms "top", "bottom", "side", "up", "down", "left", "right", "back", "front", and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the term "wireless" means any wireless signal, data, communication, or other interface including without limitation Wi-Fi, Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LTE-Advanced (LTE-A), analog cellular, NFC/RFID, CDPD, satellite systems such as GPS, millimeter wave or microwave systems, optical, acoustic, and infrared (i.e., IrDA).

Overview

The present disclosure in one aspect provides antenna feed port isolation enhancement for use with antenna assemblies comprising multiple feed ports. In one exemplary embodiment, new three-dimensional (3D) structuring techniques of plastic allow for metalized surfaces to be incorporated into or onto the plastics structures that are otherwise part of the existing antenna assembly, thereby "double-purposing" the existing structure to also enhance isolation.

In one implementation, one or more (e.g., two) plastic walls are incorporated into a bottom cover of an antenna assembly. The plastic walls are located directly under the radiating element that is located on a top cover of the antenna assembly. The two plastic walls are oriented orthogonal to one another, and are placed adjacent to antenna feed pads. In this implementation, the plastic walls are metallized using a laser direct structuring (LDS) process, and are further connected to a ground plane of an external substrate via conductive traces and external interfaces. By incorporating the metallized wall structures on the existing (e.g., plastic) structure of the bottom cover, isolation between the antenna ports is improved without requiring installation of additional components (which may themselves adversely affect isolation or other performance aspects).

Furthermore, by reducing the number of components that are necessary, costs of manufacturing are reduced.

Another salient advantage provided by exemplary embodiments of the antenna apparatus is increased reliability and manufacturing consistency in electrical and mechanical performance due to, inter alia, a reduction in (i) potential component variances from device-to-device, and (ii) failures, such as failure of metal-to-metal joint bonding between joined components.

Detailed Description of Exemplary Embodiments

Detailed descriptions of the various embodiments and variants of the apparatus and methods of the disclosure are now provided. While primarily discussed in the context of base stations or access points or femtocells, the various apparatus and methodologies discussed herein are not so limited. In fact, the apparatus and methodologies of the disclosure may be useful in any number of antennas, whether associated with mobile or fixed devices.

Furthermore, while primarily discussed in terms of manufacturing using methods such as laser direct structuring (LDS), it is recognized that the antenna embodiments discussed herein may be readily manufactured from other known methods including, for example: (1) flexible substrates; (2) sheet metal fabrication techniques; (3) fluid or vapor deposition; (4) "2-shot" molding; (5) pad printing; and (6) print deposition can be used to manufacture the various components as applicable, such techniques and structures being readily determined by those of ordinary skill when given the present disclosure.

Finally, while primarily discussed in the context of a patch antenna, it will be appreciated that the antenna apparatus disclosed herein may be arranged in a wide variety of shapes and configurations (e.g., multiband antennas, antennas operating on different operating frequency, antenna arrays, antennas with multiple feeds), with the following shapes and feed configurations merely being illustrative of the broader concepts discussed herein. Moreover, the various functions and features described herein may readily be applied to other types of antennas by those of ordinary skill when given the present disclosure.

Exemplary Antenna Element Apparatus and Methods

Referring now to FIG. 1, an exemplary implementation of an antenna assembly apparatus 100 configured in accordance with the present disclosure is shown and described in detail. As shown in FIG. 1, the exemplary antenna apparatus 100 comprises a top cover 102, having at least a portion thereof including an antenna radiating element 104 configured to support a desired operational frequency range (e.g. 2500-2700 MHz) disposed thereon. Although in the illustrative embodiment, the antenna radiating element 104 comprises a patch antenna, the principles of the disclosure are in no way so limited. The antenna radiating element 104 may be configured according to any number of various antenna configurations (for example and without limitation, PIFA's, monopoles, ceramic chip antennas and Goubau antennas). Furthermore, while the illustrative embodiment is typically used for a small cellular base station direction antenna solution, the same structure may be utilized in a variety of applications and systems, including but not limited to, femtocells, small portable radio devices, smart phones, wireless access points, etc.

In one exemplary implementation, the antenna radiating element is formed into the top cover outer (and/or inner) surface with a laser direct structuring (LDS) process. Specifically, advances in antenna manufacturing processes have enabled the construction of antennas directly onto the surface of a specialized material (e.g., a thermoplastic material that is doped with a metal additive). The doped metal additive is activated by means of a laser, which enables the construction of antennas onto more complex three-dimensional geometries. A laser is then used to activate areas of the (thermoplastic) material that are to be subsequently plated. An electrolytic copper bath followed by successive additive layers such as nickel or gold can then be added if needed to complete the construction of the antenna. LDS processes are well known to those of ordinary skill in the art, and accordingly are not described further herein.

In addition or alternatively, and according to specific implementations of the invention, deposition of a conductive fluid for the antenna radiator element is accomplished using the techniques described in co-owned and co-pending U.S. patent application Ser. No. 13/782,993 filed Mar. 1, 2013 and entitled "DEPOSITION ANTENNA APPARATUS AND METHODS", incorporated herein by reference in its entirety. For example, in one embodiment, a conductive fluid is sprayed, vapor-deposited, or otherwise disposed on the underlying substrate (e.g., plastic molding). This approach has certain advantages, including inter alia, obviating the need for more costly and time-consuming LDS processes which involve laser activation and specialized doped plastics. Moreover, precise three-dimensional shapes (including variations in width and/or height of conductive traces) can be readily formed using the foregoing techniques.

As yet another addition or alternatively, pad printing of conductive fluids could also be utilized for construction of the radiating element 104 illustrated.

The antenna apparatus illustrated in FIG. 1 further comprises a bottom cover 106 configured to interface with the top cover 102. In the illustrated embodiment, the top cover 102 is configured to be secured to the bottom cover 106 via two (2) snap features 122 that are located on the bottom cover 106, so as to provide mechanical stability as well as ease of assembly/disassembly. However, it will be appreciated that the use of other fastening techniques in order to join the top and bottom covers together may be readily used in place of or in conjunction with, the foregoing, including e.g., the use of adhesives, fasteners, heat staking of one component to the other, press-fit or other frictional technologies, and so forth, as will be recognized by those of ordinary skill given the present disclosure.

The bottom cover 106 further includes a pair of antenna feed ports 108 which each include feed port structures 110 having a feed path 112 disposed thereon. Each of the feed port structures 110 can, if desired, be manufactured using similar techniques discussed supra. Specifically, in the exemplary implementation, these feed port structures 110 are made using the aforementioned LDS processes, although deposition of conductive fluids, pad printing and/or conventional antenna construction techniques can be used in place of or in conjunction with the LDS approach.

In one exemplary implementation, each of the antenna feed ports 108 are configured to be excited at a different resonating mode in conjunction with the antenna radiating element 104 located on cover 102. The feed port structures 110 are, in the illustrated embodiment, comprised of unitary structures with the bottom cover 106. However, each of the feed port structures may comprise, in another variant, a separate structure from the bottom cover, and which is affixed thereto. The antenna feed ports 108 are configured to electrically couple with the antenna radiating element 104 located on the top cover 102. In one embodiment, the antenna feed ports 108 are capacitively coupled to the antenna radiating element 104. The antenna feed ports 108 further comprise feed terminals 120 to interface with an external substrate or structure. In addition, each of the antenna feed ports 108 are oriented so as to obtain a 90-degree difference in the polarizations between the adjacently disposed antenna feed ports 108. However, the antenna feed ports 108 may be oriented in various configurations depending on the application as would be recognizable by a person of ordinary skill given the present disclosure.

In addition or alternatively, specific implementations of the bottom cover 106 are further configured with metalized shield wall structures 114 in order to render the bottom cover unitary in construction. In one exemplary implementation, these metalized shield walls are positioned underneath, and located within the area of, the antenna radiating element 104 and are positioned orthogonal with respect to one another, as well as generally orthogonal to the top surface 101 of the top cover 102. These metalized shield walls are further configured to connect to a ground plane of an external substrate, via metalized connector traces 116, to an external substrate or device via the connection elements 118. While the connection elements 118 in the illustrative embodiment are configured to be of a surface mount type configuration, any number of mounting techniques may be used including, e.g., through-hole, press-fit, ball-grid array (BGA), etc. Moreover, the connection elements can be formed using the foregoing LDS/printing/deposition, or other techniques (e.g., along with the metallization/conductive ink layer) if desired.

Notably, the use of the foregoing unitary or one-piece structure also improves manufacturing consistency and ultimately electrical performance. Specifically, by not having separate shield elements or components that have to be place (e.g., via a pick-and-place or other manufacturing process) and attached (such as via a fastener, adhesive, friction fit, etc.), the consistency of placement and rigidity is significantly enhanced, thereby producing more consistent results in terms of electrical performance once the metallic shield elements are formed on that structure. This is true both inter-device (i.e., from one device to the next), as well as intra-device (i.e., from one shield element to the next within the same device).

The grounding of the metalized shield walls further enhances the electrical isolation between the antenna feed ports 108.

It is further appreciated that while the exemplary embodiment only illustrates the use of two antenna feed ports, and one antennal radiator element, the present disclosure is not so limited, and may be implemented with any number of feed port (e.g., three-feed, four-feed), as well as any number of antenna elements as may be required by the particular application.

In one or more variants, the bottom cover 106 is configured with various structures such as retention clips 124 for use with an external printed circuit board (PCB) or device. Additionally or alternatively, implementations of the antenna apparatus bottom cover 106 may further be configured to include mounting standoff elements and features to be used with mounting hardware (such as bolts, rivets and/or screws) to securely fasten the illustrated antenna apparatus to a PCB or other suitable substrate for use in an end device, and/or to place it in a desired orientation, standoff distance, etc., with respect to the external device to which it is mounted.

In addition or alternatively, the illustrated metallized shield walls may be installed external to the antenna apparatus and placed on, for example, an external PCB, or even on the upper cover 102. Such a shield wall configuration is configured to act as a reflector to further increase isolation of the antenna feed ports. For instance, in one implementation, the upper cover 102 is formed from a suitable material to enable LDS/printing/deposition of the reflector(s) on the outer surface thereof, such as where the regions where the reflector(s) are to be formed being constructed of doped material which is subsequently activated via laser, and then the reflector(s) applied using LDS. However, it is noted that depending on the particular configuration, external placement of the shield walls may in certain cases increase the complexity of the antenna apparatus, as well as requiring additional components separate and apart from the antenna apparatus 100, itself, and hence must be balanced against potential benefits of such external placement.

In one embodiment, the antenna ground plane of the PCB (not shown) may be configured with slots (e.g., of fixed shape) between the antenna feed ports 108 to improve isolation. In such cases, the slots typically alter the surface currents of the antenna ground plane to increase the isolation between the antenna feed ports 108. However, slots in the antenna ground plane may alter the antenna impedance matching, thereby possibly degrading the antenna's radiation characteristics.

Advantages of the illustrated embodiment of the antenna apparatus 100 include, inter alia: (i) reducing overall antenna apparatus construction complexity via the reduction in the number of discrete physical parts as compared to prior art technical solutions; and (ii) increased industrial "design freedom" resulting from use of three dimensional (3D)-friendly manufacturing technologies such as LDS, antenna deposition and pad printing.

In addition, three-dimensional (3D) LDS structuring permits integration of passive surface mount technology (SMT) components on the antenna apparatus, including into the antenna radiator itself if desired. By incorporating SMT components into the 3D LDS antenna structure, space otherwise required for such components on a printed circuit hoard is reduced, thus optimizing the use of available space for antenna apparatus. The antenna apparatus additionally may be matched and tested as one RF unit prior to host device (e.g., phone) assembly and frequency variants, tuning, and late optimization changes can be performed quickly and cost effectively. This approach also can help avoid costly rework or rebuild of the host device's main PCB, and improves time-to-market. For instance, during the manufacturing cycle, standard SMT passive matching components, such as e.g., inductors, capacitors, and connectors, are assembled on the antenna. Benefits of this solution are even more significant when realizing more complex RF designs.

Figure 2:
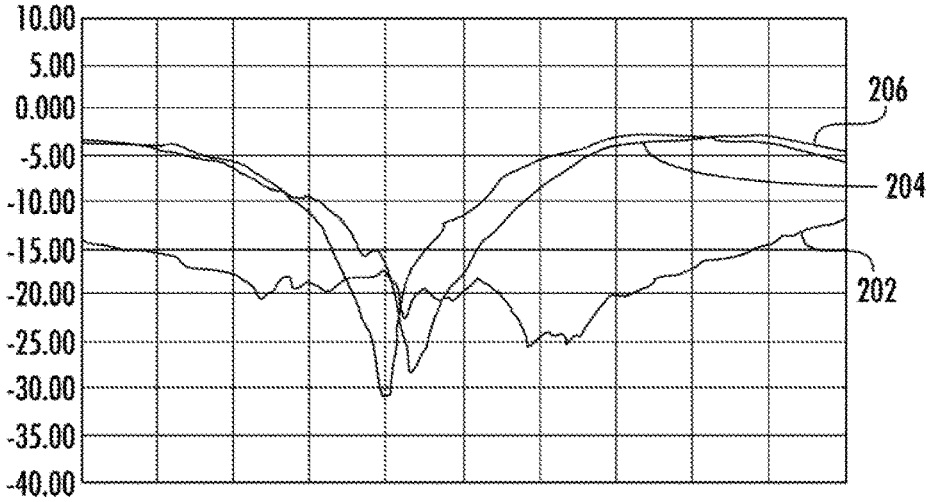
FIG. 2 is a graph of antenna isolation (dB) versus frequency of an exemplary antenna apparatus, including return loss for each of the antenna feed ports of the antenna apparatus as well as port isolation for an antenna apparatus that is not configured in accordance with the present disclosure.

Referring now to FIG. 2, a graphical illustration of return loss 204, 206 on each of the feed ports (dB), respectively, versus frequency on an antenna apparatus that does not include the isolation enhancement features (e.g., the metalized shield wall structures 114 of FIG. 1) discussed previously herein, is shown and described in detail. The graph of FIG. 2 also illustrates antenna isolation (dB) 202 versus frequency of the antenna apparatus. As can be seen from FIG. 2, the antenna isolation curve 202 for the exemplary apparatus has an antenna port isolation of approximately −20 dB at a frequency between 2.5-2.7 GHz.

Figure 3:
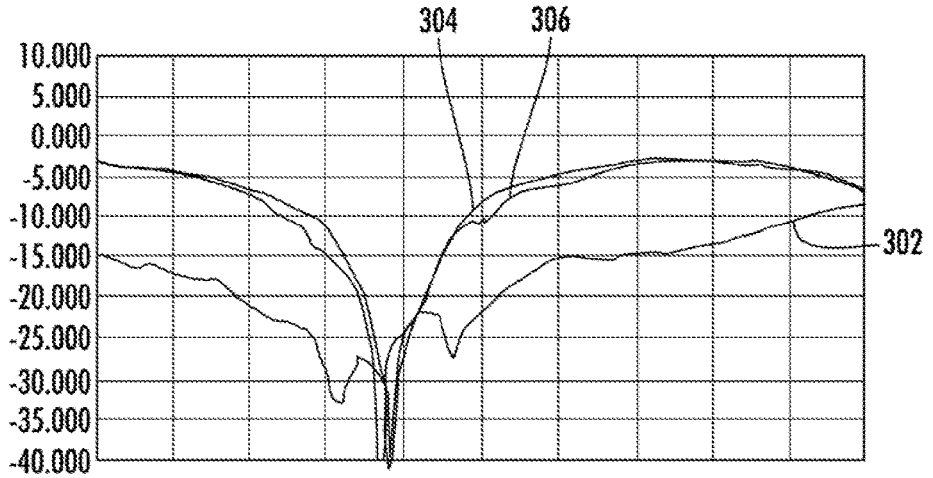
FIG. 3 is a graph of antenna isolation (dB) versus frequency of an exemplary antenna apparatus, including return loss for each of the antenna feed ports of the antenna apparatus as well as port isolation for an antenna apparatus configured in accordance with the present disclosure.

Referring now to FIG. 3, a graphical illustration of return loss 304, 306 on each of the feed ports (dB), respectively, versus frequency on an antenna apparatus that includes the isolation enhancement features shown in, for example, FIG. 1, is shown and described in detail. Similar to that shown with respect to FIG. 2, the graph also illustrates antenna isolation (dB) 302 versus frequency of the antenna apparatus. As can be seen from FIG. 3, the antenna isolation curve 302 has an antenna port isolation of approximately −25 dB at a frequency between 2.5-2.7 GHz. Although, antenna port isolation varies throughout this frequency range, antenna port isolation is improved by about 5-8 dB as compared to antenna isolation for antenna apparatus that do not include the isolation enhancement features discussed supra with respect to FIG. 1.

It is also noted that the center frequency of the port isolation curve, as shown for example in FIGS. 2 and 3 at approximately 2.6 GHz, can be controlled and set at a desired value or range by e.g., altering the length of the ground connection trace(s) 116 located on the antenna apparatus, or through use of yet other techniques that will be appreciated by those of ordinary skill given the present disclosure. In this manner, the greatest isolation can be selectively disposed within a frequency band of interest, so as to optimize overall antenna performance.

Figure 4:
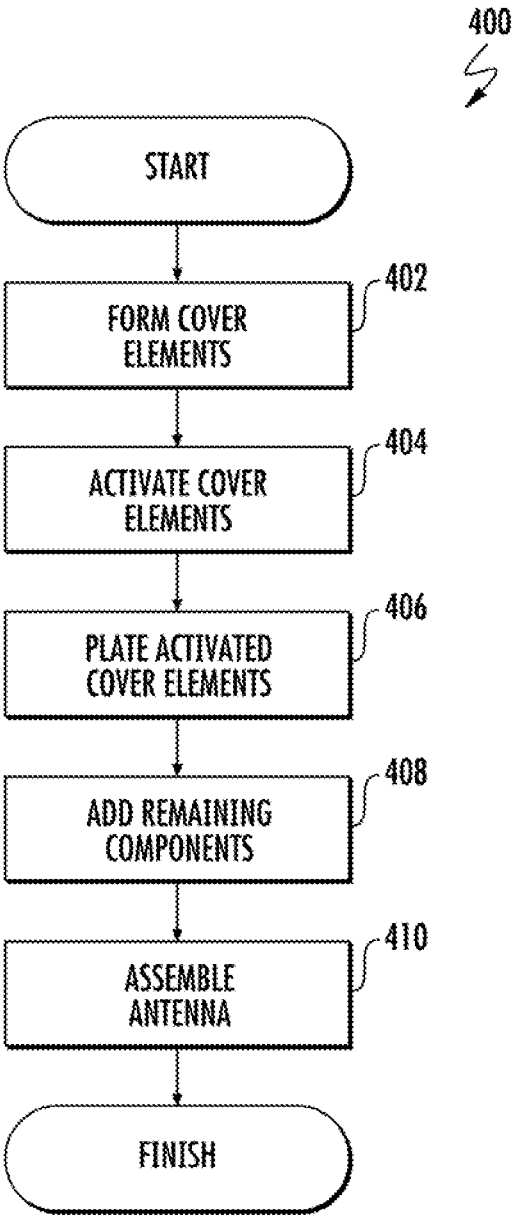
FIG. 4 is a logical flow diagram illustrating one embodiment of the method of manufacturing the antenna apparatus according to the present disclosure.

Referring now to FIG. 4, a logical flow diagram illustrating one embodiment of a method of manufacturing the antenna apparatus of the present disclosure is shown. While the embodiment of FIG. 4 is described in the exemplary context of the apparatus 100 of FIG. 1, it will be appreciated that the method may be readily adapted by those of ordinary skill, when given the present disclosure, to other configurations and embodiments. For example, in the case that a flowable conductive ink is used to print the metalized portions (e.g., shield elements) of the apparatus, steps necessary (or obviated) for such printing process can be readily substituted, added, or removed from the illustrated method.

As illustrated, the method 400 includes first forming the cover elements 102, 106, such as via a molding or other process per step 402. In one embodiment, the cover elements are formed from a specially selected polymer capable of supporting an LDS process (e.g., which is doped and which can be subsequently laser activated for LDS element formation). The cover elements 102, 106 are formed as unitary (one piece) components in this embodiment, so as to maximize manufacturing and electrical performance consistency.

Next, per step 404, the various portions of the upper and lower cover elements 102, 106 are activated, such as via laser energy, in preparation for metallic layer deposition via LDS.

Then, per step 406, the activated portions are "plated" via the LDS process, so as to form any or all of the radiator element 104, the shield elements 114, the feed ports 108 and associated contact areas, etc. as dictated by the design. Note that discrete or integrated SMT or other components (as described above) may also be added as part of this step (or a separate precursor process).

Lastly, any remaining components are added to the upper and lower cover elements (e.g., fasteners, wires, etc.) per step 408, and the antenna assembly is assembled (e.g., by mating top and bottom cover elements) per step 410. It may then be tested, labeled, and/or otherwise prepared if/as desired.

It will further be appreciated that while the foregoing exemplary apparatus and methods are described primarily with respect to the design and manufacture of a new device. The various techniques and features disclosed herein can, in certain cases, also be adapted or retrofitted onto existing designs. For instance, where an existing design meets other design criteria (e.g., is suitably spatially compact, etc.), yet it is desired to enhance antenna port isolation, deposition of the metallic shield elements (such as via the aforementioned deposition or printing processes using flowable conductive ink) onto existing structures such as those internal to the housing enclosure, or even on exterior surfaces thereof, may be used to enhance the isolation.

It will be recognized that while certain aspects of the disclosure are described in terms of a specific sequence of steps of a method, these descriptions are only illustrative of the broader methods, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the disclosure and claims provided herein.

While the above detailed description has shown, described, and pointed out novel features as applied to various embodiments, it will be understood that various omissions, substitutions, and changes in the form and details of the device or process illustrated may be made by those skilled in the art. The foregoing description is of the best mode presently contemplated. This description is in no way meant to be limiting, but rather should be taken as illustrative of the general principles of the disclosure.

What is claimed is:

1. An antenna port isolation apparatus comprising:

a housing for the apparatus, the housing comprising:

a first cover element comprising at least one antenna radiating element disposed on an exterior surface of the housing; and a second cover element comprising:

at least two feed port structures disposed inside the housing;

at least two feed ports each at least partly disposed on a respective one of the at least two feed port structures, where the at least two feed ports are electrically coupled to the at least one antenna radiating element; and at least two metallized shield wall elements, at least a portion of the at least two metallized shield wall elements being positioned between the first and second cover elements, each of the at least two metallized shield wall elements being disposed orthogonal to at least another one of the at least two metallized shield wall elements;

wherein the at least two metallized shield elements are formed from wall structures of the second cover element; and wherein each of the at least two feed ports are arranged on the second cover element so as to have an orthogonal polarization with respect to one another.

2. The antenna apparatus of claim 1, wherein the second cover element comprises a unitary structure.

3. The antenna apparatus of claim 2, wherein the second cover element comprises a laser direct structuring (LDS) polymer.

4. The antenna apparatus of claim 3, wherein the first cover element comprises an LDS polymer.

5. The antenna apparatus of claim 3, wherein the at least two feed ports are arranged on the second cover element so as to be disposed orthogonal with one another.

6. The antenna apparatus of claim 1, wherein the at least two metallized shield wall elements are arranged so as to be generally orthogonal with a top surface of the first cover element when the first cover element is assembled with the second cover element.

7. The antenna apparatus of claim 6, further comprising a ground plane, the at least two metallized shield wall elements being coupled to the ground plane, thereby enhancing the electrical isolation between the at least two feed ports.

8. The antenna apparatus of claim 1, wherein each of the at least two feed ports are configured to be excited at a different resonating frequency.

9. The antenna apparatus of claim 8, wherein the at least two feed ports are configured to be capacitively coupled to the at least one antenna radiating element.

10. An antenna port isolation apparatus comprising:

a first discrete housing portion comprising an antenna radiating element; and a second discrete housing portion configured to interface with the first discrete housing portion, the second discrete housing portion comprising:

a pair of feed ports disposed on feed port structures, the feed port structures being disposed on an inner surface of the second discrete housing portion, where the pair of feed ports are electrically coupled to the antenna radiating element; and a pair of metallized shield wall elements, the metallized shield wall elements being unitary with the second discrete housing portion, where at least a portion of the pair of metallized shield wall elements are positioned between the first and second discrete housing portions, each of the pair of metallized shield wall elements being configured so as to be arranged orthogonal to the other one of the pair of metallized shield wall elements;

wherein each of the pair of feed ports are arranged on the second discrete housing portion so as to have an orthogonal polarization with respect to one another.

11. The antenna apparatus of claim 10, wherein the pair of feed ports are arranged on the second discrete housing portion so as to be orthogonal with one another.

12. The antenna apparatus of claim 11, wherein each of the pair of metallized shield wall elements are arranged so as to be orthogonal with one another.

13. The antenna apparatus of claim 12, wherein the pair of metallized shield wall elements are arranged so as to be orthogonal with a top surface of the first discrete housing portion.

14. The antenna apparatus of claim 13, further comprising a ground plane, the pair of metallized shield wall elements being coupled to the ground plane, thereby enhancing the electrical isolation between the pair of feed ports.

15. The antenna apparatus of claim 10, wherein each of the pair of feed ports are configured to be excited at a different resonating frequency.

16. The antenna apparatus of claim 15, wherein the pair of feed ports are configured to be capacitively coupled to the antenna radiating element.

17. An antenna port isolation apparatus comprising:

a first cover element of a housing, the first cover element comprising an antenna radiating element, the antenna radiating element disposed on an outer surface of the first cover element;

a second cover element of the housing, the second cover element being configured to interface with the first cover element, the second cover element comprising:

two feed ports each comprising:

a respective feed path and a respective feed terminal, each of the two feed ports and the respective feed path being disposed on respective feed port structures;

where each of the two feed ports are disposed at an orthogonal orientation with respect to one another, the two feed ports being configured to obtain a 90-degree difference in polarizations between the two feed ports, and the two feed ports are configured to be capacitively coupled with the radiating element on the first cover element; and two metallized shield wall structures, at least a portion of the two metallized shield wall structures being positioned between the first and second cover elements;

where the two metallized shield wall structures are disposed on the second cover element, at least a portion of the two metallized shield wall structures being disposed underneath the first cover element when the first cover element is mated to the second cover element, and each disposed at an orthogonal orientation with respect to one another and to the outer surface of the first cover element; and where each of the two metallized shield wall structures are configured to galvanically connect to a ground of an electronics component external to the housing, the galvanic connection being made via respective connector traces.

18. The antenna apparatus of claim 17, wherein the second cover element comprises a unitary structure with (i) the two metallized shield wall structures and (ii) the two feed ports.

19. The antenna apparatus of claim 17, wherein the connection to the ground is configured to enhance an electrical isolation between the two feed ports as compared with another antenna apparatus having two metallized shield wall structures not connected to respective grounds.

20. The antenna apparatus of claim 17, wherein the antenna radiating element is formed on the outer surface of the first cover element with a laser direct structuring (LDS) process.

* * * * *